US010738777B2

(12) United States Patent
Crum et al.

(10) Patent No.: US 10,738,777 B2
(45) Date of Patent: Aug. 11, 2020

(54) SCROLL COMPRESSOR WITH PARTIAL LOAD CAPACITY

(71) Applicant: TRANE INTERNATIONAL INC., Davidson, NC (US)

(72) Inventors: Daniel R. Crum, Huntersville, NC (US); Eric S. Mlsna, Cashton, WI (US); Jerry A. Rood, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 58 days.

(21) Appl. No.: 16/306,819

(22) PCT Filed: Jun. 2, 2017

(86) PCT No.: PCT/US2017/035741
§ 371 (c)(1),
(2) Date: Dec. 3, 2018

(87) PCT Pub. No.: WO2017/210594
PCT Pub. Date: Dec. 7, 2017

(65) Prior Publication Data

US 2019/0293070 A1 Sep. 26, 2019

Related U.S. Application Data

(60) Provisional application No. 62/344,737, filed on Jun. 2, 2016.

(51) Int. Cl.
*F04C 18/02* (2006.01)
*F04C 23/00* (2006.01)
(Continued)

(52) U.S. Cl.
CPC ..... *F04C 18/0215* (2013.01); *F04C 18/0253* (2013.01); *F04C 18/0261* (2013.01);
(Continued)

(58) Field of Classification Search
CPC ..... F04C 18/0215; F04C 18/0253; F04C 18/0261; F04C 29/028; F04C 29/021; F04C 28/24; F04C 28/26
See application file for complete search history.

(56) References Cited

U.S. PATENT DOCUMENTS 4,431,388 A 2/1984 Eber et al.
4,514,150 A 4/1985 Hiraga et al.
(Continued)

FOREIGN PATENT DOCUMENTS

CN 1644928 A 7/2005
CN 101672276 A 3/2010
(Continued)

OTHER PUBLICATIONS

Extended European Search Report; European Patent Application No. 17807594.1, dated Dec. 10, 2019 (5 pages).
(Continued)

*Primary Examiner* — Mary Davis
(74) *Attorney, Agent, or Firm* — Hamre, Schumann, Mueller & Larson, P.C.

(57) ABSTRACT

A scroll compressor lubrication system and a scroll compressor are disclosed. The scroll compressor includes a capacity modulator, a lubricant opening, and a gas diverting passage. The capacity modulator is in fluid communication with compression pockets for selectively unloading gas from the pockets. The lubricant opening is in fluid communication with at least one bearing portion of the scroll compressor. Lubricant from the at least one bearing portion in the scroll compressor flows through the lubricant opening. The gas diverting passage includes an inlet and an outlet. The inlet of the gas diverting passage is in fluid communication with the capacity modulator, and the gas diverting passage extends below the lubricant opening such that gas from the outlet of the gas diverting passage can flow through a travel path of
(Continued)

the lubricant that flows through the lubricant opening and entrains at least part of the lubricant to at least one bearing portion for lubrication.

21 Claims, 3 Drawing Sheets

(51) Int. Cl.
*F04C 28/10* (2006.01)
*F04C 29/02* (2006.01)
*F04C 28/24* (2006.01)

(52) U.S. Cl.
CPC ..... *F04C 23/008* (2013.01); *F04C 28/10* (2013.01); *F04C 28/24* (2013.01); *F04C 29/021* (2013.01); *F04C 29/028* (2013.01)

(56) References Cited

U.S. PATENT DOCUMENTS

| | | | |
|---|---|---|---|
| 4,815,944 | A | 3/1989 | Maruyama et al. |
| 4,846,633 | A | 7/1989 | Suzuki et al. |
| 4,940,395 | A | 6/1990 | Yamamoto et al. |
| 5,059,098 | A | 10/1991 | Suzuki et al. |
| 5,169,294 | A | 12/1992 | Barito |
| 5,193,987 | A | 3/1993 | Iio et al. |
| 5,248,244 | A | 9/1993 | Ho et al. |
| 5,269,661 | A | 12/1993 | Iizuka et al. |
| 5,451,146 | A | 9/1995 | Inagaki et al. |
| 5,551,846 | A | 9/1996 | Taylor et al. |
| 5,613,841 | A | 3/1997 | Bass et al. |
| 5,678,985 | A | 10/1997 | Brooke et al. |
| 5,772,411 | A | 6/1998 | Crum et al. |
| 5,993,171 | A | 11/1999 | Higashiyama |
| 5,993,177 | A | 11/1999 | Terauchi et al. |
| 6,042,344 | A | 3/2000 | Lifson et al. |
| 6,095,765 | A | 8/2000 | Khalifa |
| 6,244,834 | B1 | 6/2001 | Matsuda et al. |
| 6,413,058 | B1 | 7/2002 | Williams et al. |
| 6,478,550 | B2 | 11/2002 | Matsuba et al. |
| 6,821,092 | B1 | 11/2004 | Gehret et al. |
| 7,052,255 | B2 | 5/2006 | Hong et al. |
| 7,316,549 | B2 | 1/2008 | Kim et al. |
| 7,335,004 | B2 | 2/2008 | Lee et al. |
| 7,371,057 | B2 | 5/2008 | Shin et al. |
| 7,381,037 | B2 | 6/2008 | Kim et al. |
| 7,674,098 | B2 | 3/2010 | Lifson |
| 7,967,582 | B2 | 6/2011 | Akei et al. |
| 7,967,583 | B2 | 6/2011 | Stover et al. |
| 7,976,295 | B2 | 7/2011 | Stover et al. |
| 7,988,433 | B2 | 8/2011 | Akei et al. |
| 7,988,434 | B2 | 8/2011 | Stover et al. |
| 8,177,522 | B2 | 5/2012 | Kiem et al. |
| 8,186,970 | B2 | 5/2012 | Cho |
| 8,308,448 | B2 | 11/2012 | Fields et al. |
| 8,313,318 | B2 | 11/2012 | Stover et al. |
| 8,328,531 | B2 | 12/2012 | Milliff et al. |
| 2007/0036661 | A1 | 2/2007 | Stover |
| 2008/0107555 | A1 | 5/2008 | Lifson |
| 2010/0158710 | A1 | 6/2010 | Umemura et al. |
| 2018/0355868 | A1* | 12/2018 | Diao ..... F04C 18/0215 |

FOREIGN PATENT DOCUMENTS

| | | | |
|---|---|---|---|
| CN | 101806301 | A | 8/2010 |
| CN | 202926628 | U | 5/2013 |
| EP | 2163766 | A2 | 3/2010 |
| JP | 2013108389 | A | 6/2013 |
| WO | 2006/032638 | A1 | 3/2006 |
| WO | 2006/132638 | A1 | 12/2006 |

OTHER PUBLICATIONS

International Search Report and Written Opinion, International Patent Application No. PCT/US2017/035741, dated Aug. 29, 2017 (8 pages).

Office Action; Chinese Patent Application No. 201780047250.2, dated Aug. 1, 2019, with partial English translation (7 pages).

* cited by examiner

SCROLL COMPRESSOR WITH PARTIAL LOAD CAPACITY

FIELD

The embodiments described herein relate generally to a scroll compressor. More particularly, the embodiments described herein relate to a scroll compressor that facilitates lubricant circulation and provides enhanced lubrication for bearing portions in a scroll compressor operating at partial loads.

BACKGROUND

One type of compressor is a scroll compressor. For example, the scroll compressor is widely used in HVAC heat pump and air conditioning systems. In a scroll compressor, a scroll set including a first, stationary, non-orbiting scroll and a second, rotating, orbiting scroll both of which have a base and a generally spiral wrap extending from the base is provided. The non-orbiting scroll and the orbiting scroll intermesh with each other during operation of the scroll compressor, and a plurality of pockets are defined between the intermeshed involutes of the non-orbiting scroll and the orbiting scroll for compressing gas trapped therein. The orbiting scroll is driven to orbit by a rotating drive shaft which is typically driven by a motor. The orbiting motion of the scroll set gathers gas to be compressed at the perimeter, pockets the gas, and compresses the gas as the orbiting proceeds toward the center of the scroll set.

SUMMARY

Some scroll compressors have unloading capabilities to satisfy changing compression needs. Modulation of operating capacity can be achieved by bypassing gas from the pockets for compressing gas and short circuit back to a gas entrance to the scroll set.

Working at partial capacity may cause bearing portions at the upper part of a scroll compressor to fail prematurely. It is well known that lubricant should be supplied to the bearing portions for lubrication.

To feed lubricant to the bearing portions in the upper part of the compressor, gas suctioned into the compressor is employed to flow past a lubricant region (e.g. an oil sump at the bottom of the compressor shell) where lubricant is stored or accumulated and pick up some lubricant to transport the lubricant to the bearing portions in the upper part of the compressor (e.g. the involute flank surface of the scroll set and the sliding surface of the Oldham coupling that connects with the scroll set for maintaining the orientation of the orbiting scroll with respect to the non-orbiting scroll) for lubrication. However, when a scroll compressor operates at partial capacity, the short-circuited gas does not flow past the lubricant region and the flow of the suctioned gas flow passing the lubricant region is not high enough to carry sufficient lubricant to the bearing portions in the upper part of the compressor. Additionally, as gas velocity drops through the upper part of the compressor, it becomes difficult to pick up lubricant and entrain it in the gas flow. The bearing portions without sufficient lubrication may fail prematurely.

In view of the foregoing, there is a need to provide a scheme for enhancing lubrication of the bearing portions in a scroll compressor with partial-load operating capacity. Embodiments herein are directed to the pick up of lubricant to transport the lubricant to the bearing portions in the upper part of the compressor (e.g. the involute flank surface of the scroll set and the sliding surface of the Oldham coupling that connects with the scroll set for maintaining the orientation of the orbiting scroll with respect to the non-orbiting scroll) for lubrication.

According to one embodiment, a scroll compressor includes a shell adapted to contain a lubricant, a scroll set provided in the shell, a capacity modulator, a lubricant opening, and a gas diverting passage in the shell. The scroll set includes an orbiting scroll and a non-orbiting scroll, and pockets are defined between the orbiting scroll and the non-orbiting scroll for compressing gas. The capacity modulator is in fluid communication with the pockets for selectively unloading gas from the pockets. A lubricant opening is in fluid communication with at least one bearing portion of the scroll compressor. Lubricant from the at least one bearing portion in the scroll compressor flows through the lubricant opening cavity. The gas diverting passage includes an inlet and an outlet. The inlet of the gas diverting passage is in fluid communication with the capacity modulator, and the gas diverting passage extends below the lubricant opening such that gas from the outlet of the gas diverting passage can flow through a travel path of the lubricant that flows through the lubricant opening and entrains at least part of the lubricant to at least one bearing portion in the scroll compressor for lubrication.

According to another embodiment, a scroll compressor includes a shell adapted to contain a lubricant, a scroll set, a drive shaft, a capacity modulator, a lubricant opening, and a gas diverting passage provided in the shell. The scroll set further includes an orbiting scroll and a non-orbiting scroll, and pockets are formed between the orbiting scroll and the non-orbiting scroll for compressing gas. The drive shaft is operatively connected with the orbiting scroll. The capacity modulator is in fluid communication with the pockets for selectively unloading gas from the pockets. The lubricant opening is in fluid communication with at least one bearing portion of the scroll compressor. The gas diverting passage includes an inlet and an outlet. The inlet of the gas diverting passage is in fluid communication with the capacity modulator. The gas diverting passage extends below the lubricant opening such that gas from an outlet of the gas diverting passage can flow through the lubricant that exits from the lubricant opening and entrain the lubricant to a region around the scroll set for lubricating at least one bearing portion in the region.

According to yet another embodiment, a lubrication system for a scroll compressor includes a lubricant opening and a gas diverting passage in a shell of the scroll compressor. The scroll compressor applicable to this embodiment includes the shell, a scroll set, a capacity modulator with a port and a drive shaft in the shell. The shell is adapted to contain lubricant. The scroll set further includes an orbiting scroll and a non-orbiting scroll with pockets being defined between the orbiting scroll and the non-orbiting scroll for compressing gas. The drive shaft is associated with the orbiting scroll. The port of the capacity modulator is in fluid communication with the pockets for selectively unloading gas. The lubricant opening is in fluid communication with the at least one bearing portion of the scroll compressor. The gas diverting passage includes an inlet and an outlet. The inlet of the gas diverting passage is adapted to be in fluid communication with the port of the capacity modulator. The gas diverting passage extends below the lubricant opening such that gas from an outlet of the gas diverting passage can flow through the lubricant that exits from the lubricant opening and entrain the lubricant to at least one bearing portion in the scroll compressor for lubrication.

DRAWINGS

These and other features, aspects, and advantages of the scroll compressor will become better understood when the following detailed description is read with reference to the accompanying drawing, wherein.

While the above-identified drawing figures set forth particular embodiments of the lubrication methods and systems, other embodiments are also contemplated, as noted in the discussion. In all cases, this disclosure presents illustrated embodiments of the scroll compressor with capability to operate at partial capacity by way of representation and not limitation. Numerous other modifications and embodiments can be devised by those skilled in the art which fall within the scope and spirit of the principles of the lubrication methods and systems described herein.

DETAILED DESCRIPTION

Figure 1:
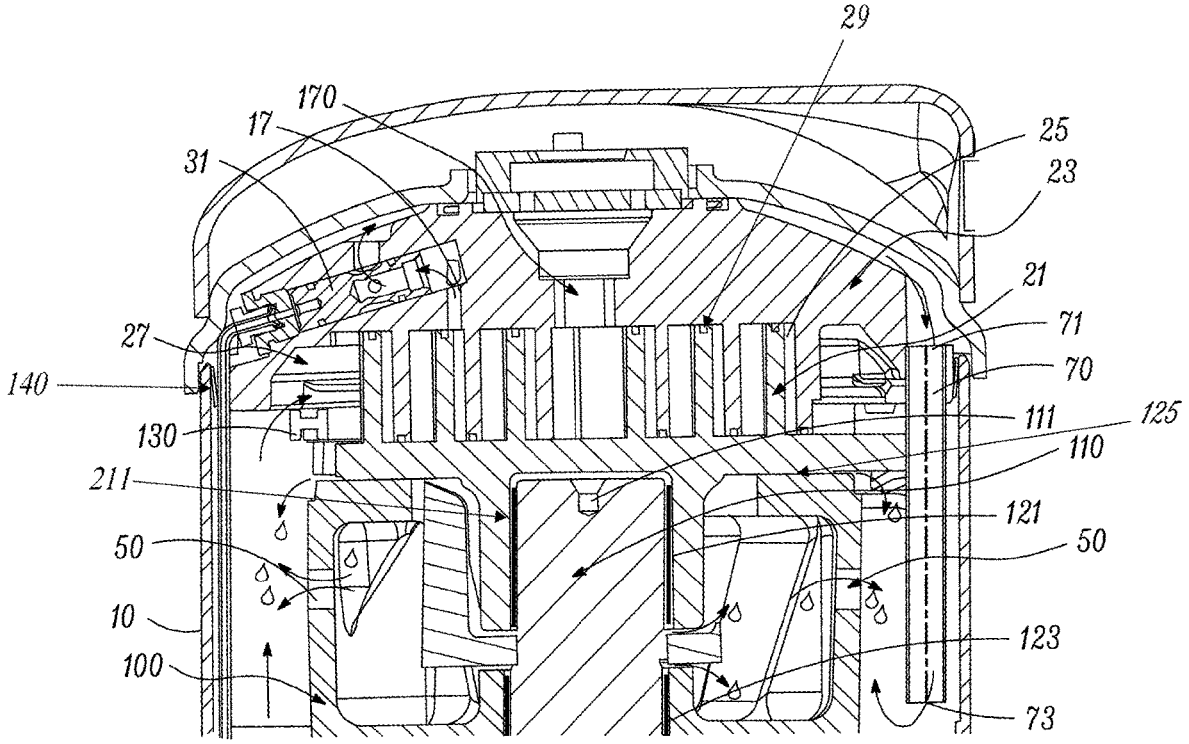
FIG. 1 is a partial cross-sectional side view of a scroll compressor with capability to operate at partial capacity, according to one embodiment.
Figure 2:
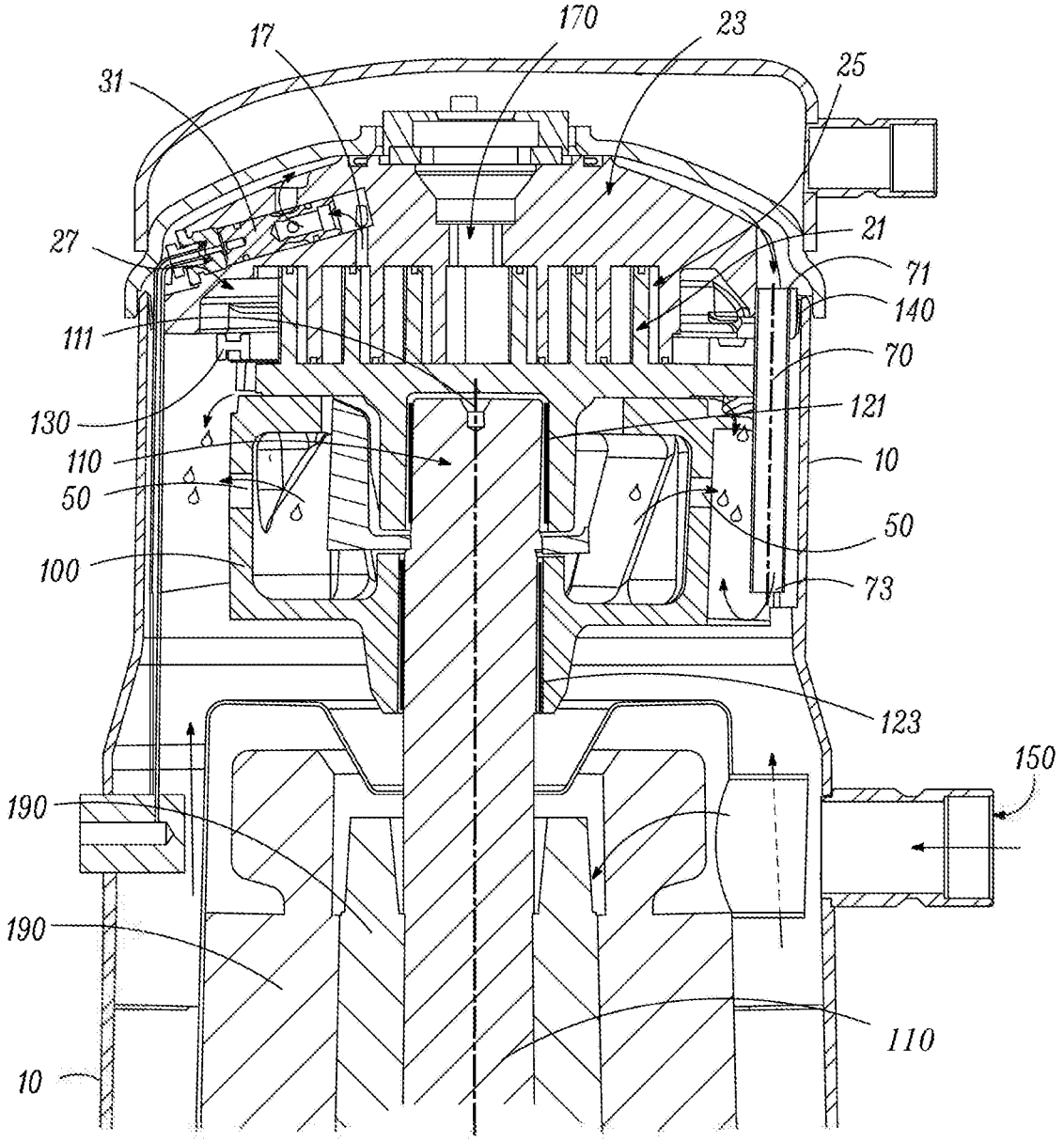
FIG. 2 is another partial cross-sectional side view of the scroll compressor with capability to operate at partial capacity, according to the embodiment.

FIG. 1 is a partial cross-sectional side view of a scroll compressor with capability to operate at partial capacity, according to one embodiment. FIG. 2 is another partial cross-sectional side view of the scroll compressor with capability to operate at partial capacity, according to an embodiment. FIGS. 1 and 2 respectively illustrate different parts and details of the scroll compressor.

The scroll compressor illustrated in FIGS. 1 and 2 comprises a shell 10, a scroll set, a capacity modulator, a lubricant opening 50 and a gas diverting passage, which is a tube 70 in this embodiment. A suction port 150 is typically provided in the shell 10 for allowing refrigerant gas to be compressed to flow in. The gas to be compressed may also be gas other than refrigerant. The scroll set includes an orbiting scroll 21 and a non-orbiting scroll 23. The orbiting scroll 21 is driven by a drive shaft 110 to orbit relative to the non-orbiting scroll 23. The capacity modulator includes a slide valve 31 and a port 17 that is formed in the non-orbiting scroll 23.

As the involutes of the orbiting scroll 21 and the non-orbiting scroll 23 intermesh, crescent-shaped pockets 25 are formed as compression chambers bounded by the spiral wraps and the bases of both scrolls. As the orbiting scroll 21 orbits about the non-orbiting scroll 23, the pockets 25 follow the wrap spiral toward the center and diminish in size. The scroll set has low and high pressure ends where a gas entrance 27 and a discharge port 170 are respectively provided. The gas at suction pressure enters the gas entrance 27 from a suction area at the low pressure end of the compressor and enters the pockets 25. The pockets 25 are initially open to the gas entrance 27 and closed to the discharge port 170. As the scroll set moves, the pockets 25 are closed off from the gas entrance 27 and compression of the gas begins as the pockets' volume begins to diminish toward the high pressure end of the compressor close to the discharge port 170. When the compressor operates at full capacity, the pockets 25 are displaced into communication with the discharge port 170 through which the compressed gas is discharged from the pockets 25.

The capacity modulator is in fluid communication with the pockets 25 for selectively unloading gas from the pockets 25. The slide valve 31 (e.g. a slide piston) is employed to modulate the compression capacity. The slide valve 31 can be built into the non-orbiting scroll 23 and is moveable to expose a portion of one or more of the pockets 25 to the port 17 so as to allow gas to exit the pocket(s) 25 and return to the region surrounding the scroll set at suction pressure. The port 17, when uncovered by the movement of the slide valve 31, acts to delay the start of compression within the scroll set and consequently reduces the built-in suction volume in the pockets 25.

In effect, capacity modulation is obtained, through the use of the slide valve 31, by reducing the effective length of the scroll sets (i.e. the pockets 25). When the slide valve 31 is closed (e.g. on the right side in FIGS. 1 and 2), the compressor is fully loaded and operates at full capacity. When the slide valve 31 is fully open (e.g. on the left side in FIGS. 1 and 2), that is, when the portion of the pocket(s) 25 exposed to suction pressure other than through the gas entrance 27 is at its greatest, the compressor runs unloaded to the maximum extent. The slide valve 31 may be pulsed periodically to obtain a capacity between the full-open and the full-close state. It should be noted that other capacity modulators applicable to this embodiment can also be employed.

In an embodiment, the lubricant opening 50 is in fluid communication with at least one bearing portion. In an embodiment, the lubricant opening(s) 50 can drain lubricant from the at least one bearing portion. The drive shaft 110 is typically encircled by shaft bearings 121, 123 at its upper part. The shaft bearing 121 is disposed in a depending boss 211 of the orbiting scroll 21. An eccentric shaft pin 111 provided at the top end of the drive shaft 110 is received in the shaft bearing 121. The shaft bearing 121 couples the drive pin 111 and the orbiting scroll 21 in driving engagement. The shaft bearing 123 is disposed in the frame 100 for radially supporting the drive shaft 110. The lubricant opening 50 can be provided in the form of a cavity by drilling in the frame 100. Lubricant mainly from the shaft bearings 121 and 123 accumulates in and flows out of the lubricant opening 50 for example by way of being forced out, e.g. slung and/or sprayed out by the counterweight and may also be drained out by way of gravity. The lubricant opening 50 can be disposed at any other positions in the shell 10 close to bearing portions in the compressor to act as a port for lubricant to flow from the bearing portions. In an embodiment, the lubricant opening 50 illustrated in FIGS. 1 and 2 is a mechanism for managing lubricant circulation rate (OCR), e.g. ratio of lubricant to gas. The lubricant opening 50 may also be a mechanism dedicated to draining off lubricant provided at the lower part of the compressor. For example, a lubricant opening may be formed to collect lubricant sprayed against the shell 10.

In an embodiment, the gas diverting passage includes the tube 70 provided between the scroll set perimeter and the shell 10. The tube 70 may vertically extend below the lubricant opening 50. The tube 70 has an inlet 71 and an outlet 73. The tube inlet 71 is in fluid communication with the port 17 of the capacity modulator. The tube outlet 73 is at a lower position then the tube inlet 71. The short-circuited gas exiting the capacity modulator is diverted, flows into the tube inlet 71, down through the tube 70, turns at the tube outlet 73 and then flows past the travel path of the lubricant coming out of the lubricant opening 50. The gas entrains some lubricant while flowing past the lubricant travel path and transports the lubricant to some or all bearing portions in the upper part of the compressor to recirculate the lubricant for lubricating the bearing portions there. As shown in FIG. 1, the diverted gas flow may be joined by the suction gas flow entering into the compressor through the suction port 150 before flowing past the travel path of the lubricant. In such a situation, more lubricant may be entrained by the joined gas flow of the diverted gas from the tube 70 and the suction gas from the suction port 150.

In an embodiment, main gas in the scroll compressor can pick up lubricant from the lubricant opening(s) 50 and /or lubricant coming out of the thrust bearing between e.g. the orbiting scroll and the bearing housing or frame 100. The recirculating gas can also pick up lubricant from the lubricant opening(s) 50 and/or lubricant coming out of the thrust bearing.

In an embodiment, the area, clocking and relative height of the lubricant opening 50 may be selected to regulate the ability of the gas to pick up the lubricant and carry it to the bearing portion for lubrication.

Likewise, the area, clocking, and relative height of the outlet 73 of the tube 70 may be selected to regulate the ability of the gas to pick up the lubricant and carry it to the bearing portion for lubrication.

For example, a dimension "d", for example a height or distance of the outlet 73 relative to any of the location of the lubricant opening(s) 50 and/or the location of the thrust bearing 125 can be selected, determined, or otherwise configured to control how much lubricant may be picked up by the recirculation gas.

Likewise, in combination with this relative elevational dimension, the geometry, e.g. the area, clocking, diameter, orientation, angle, and/or sizing of the lubricant opening(s) 50 and/or the outlet 73 may be selected to obtain optimized lubricant pick, or otherwise suitable lubricant pick up depending on the desired application.

It will be appreciated that such concepts also apply to outlet 93 of the opening 90 described further below in FIG. 3 and to the concepts of the recirculation gas described herein.

In an embodiment, the outlet 73 of the tube 70 and/or the outlet 93 of the opening 90 have a configuration and have a relative location to the lubricant opening(s) 50, drains, and/or thrust bearing, such that a desired, suitable or otherwise sufficient amount of lubricant would be observed and is potentially available for pick up back to the upper portions of the scroll compressor (e.g. bearing surfaces such as the surfaces of the Oldham coupling and involute flank surfaces of the scroll).

Four tubes 70 may be provided at four locations of the shell 10. Alternatively, one, two, three, or six tubes may also be provided. There is no limit on the number of the tubes 70. The overall flow area of all the tubes 70, i.e. the overall cross sectional area of all the tubes, is greater than the flow area of gas coming down from the capacity modulator to reduce pressure drop/flow restriction of the gas while flowing through the tubes 70.

The at least one bearing portion in the scroll compressor for lubrication may be a flank surface of the scroll set and/or a sliding surface of a coupling 130 at the upper part of the compressor to prevent them from failing prematurely and assisting in sealing leakage paths between the pockets 25 for improving compression efficiency. The coupling 130, commonly referred to as an Oldham coupling, connects with the scroll set for maintaining the orientation of the orbiting scroll 21 with respect to the non-orbiting scroll 23. The at least one bearing portion may also include a tip seal 29 which is fitted on the involutes of the scroll set. A thrust bearing 125 is often disposed between the orbiting scroll 21 and the shell 10 for support the thrust load imposed in an axial direction upon the orbiting scroll 21. In an embodiment, the at least one bearing portion may also include this thrust bearing 125.

The scroll compressor may further have a seal member 140 for preventing gas from leaking in the course of the gas exiting the capacity modulator to the inlet of the gas diverting passage. The seal member 140 may be an O-ring or a lip seal disposed between the non-orbiting scroll 23 and the shell 10. Alternatively, the seal member 140 may be formed by a clearance of a proper size between the non-orbiting scroll 23 and the shell 10. The clearance should be small enough to cause at least the majority of the gas flow exiting the capacity modulator to flow through the gas diverting passage.

Figure 3:
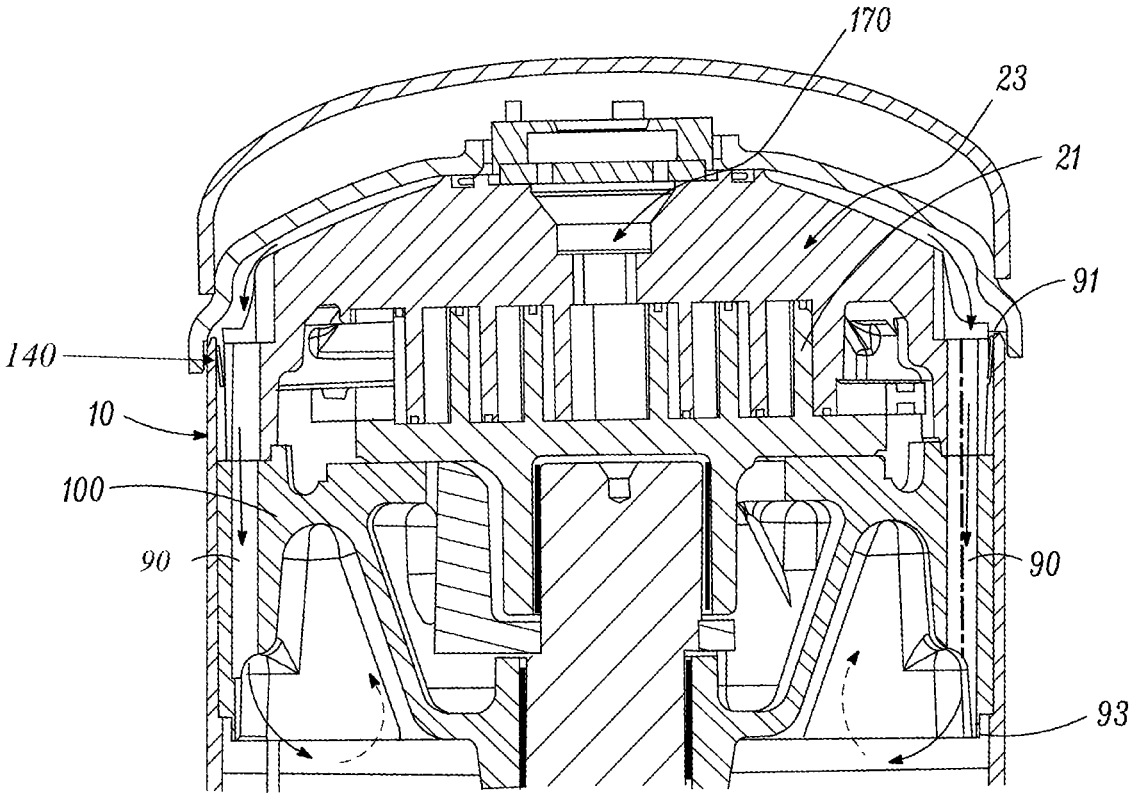
FIG. 3 is a partial cross-sectional side view of a scroll compressor with capability to operate at partial capacity, according to another embodiment.

FIG. 3 is a partial cross-sectional side view of a scroll compressor with partial capacity, according to another embodiment. In this embodiment, an opening 90 is formed in the frame 100 as the gas diverting passage. The opening 90 may be formed by drilling, casting, and other machining processes. The opening outlet 93 is at a lower position than the opening inlet 91 for diverting the short-circuited gas down to flow past the travel path of the lubricant. The number of the openings 90 may be one or more openings. An existing compressor may be retrofitted with such an opening 90 by drilling axially-oriented holes in the frame 100. It will be appreciated that this embodiment may also apply to new compressor builds. Other details of this embodiment can be referred to the description of the embodiments present above.

Although the embodiments are described herein with reference to vertical scroll compressors, the principles described herein may just as easily be applied to non-vertical scroll compressors. For non-vertical scroll compressors, the lubricant opening 50 in the upper part of the shell 10 is located at the lowest position. The gas flow to the scroll set is controlled, for example, with baffles or a single inlet to the scroll set so that the gas flow allows the lubricant to rain into the gas flow. Further, it will be appreciated that the principles described herein may be applied to single stage and multi-stage compressors and also including but not limited to parallel flow compressors.

In the embodiments, gas from a capacity modulator for selectively unloading gas is diverted through a gas diverting passage to entrain lubricant and recirculate lubricant to at least one bearing portion in the compressor for lubricating the at least one bearing portion. Adequate lubrication of the bearing portions, particularly those at the upper part of the compressor, is ensured when the compressor operates at partial capacity. The cost for implementing embodiments described herein is relatively low. The embodiments are also applicable to existing compressors as a potential retrofit application.

The terminology used in this specification is intended to describe particular embodiments and is not intended to be limiting. The terms "a," "an," and "the" include the plural forms as well, unless clearly indicated otherwise. The terms "comprises" and/or "comprising," when used in this specification, indicate the presence of the stated features, integers, steps, operations, elements, and/or components, but do not preclude the presence or addition of one or more other features, integers, steps, operations, elements, and/or components.

With regard to the preceding description, it is to be understood that changes may be made in detail, especially in matters of the construction materials employed and the shape, size, and arrangement of parts, without departing from the scope of the present disclosure. The word "embodiment" as used within this specification may, but does not necessarily, refer to the same embodiment. This specification and the embodiments described are examples only. Other and further embodiments may be devised without departing from the basic scope thereof, with the true scope and spirit of the disclosure being indicated by the aspects that follow.

ASPECTS

Any one or more of aspects 1 to 10 can be combined with any one or more of aspects 11 to 21, and any one or more of aspects 11 to 18 may be combined with any of one or more of aspects 19 to 21, and any of aspects 19 and 20 may be combined with aspect 21.

1. A scroll compressor, comprising:
   a shell adapted to contain a lubricant;
   a scroll set in the shell, the scroll set including an orbiting scroll and a non-orbiting scroll, wherein pockets being defined between the orbiting scroll and the non-orbiting scroll for compressing gas;
   a capacity modulator in fluid communication with the pockets for selectively unloading gas from the pockets;
   a lubricant opening in fluid communication with at least one bearing portion of the scroll compressor, lubricant from the at least one bearing portion of the scroll compressor flows through the lubricant opening; and
   a gas diverting passage in the shell, the gas diverting passage including an inlet and an outlet, the inlet of the gas diverting passage being in fluid communication with the capacity modulator, and the gas diverting passage extending below the lubricant opening such that gas from the outlet of the gas diverting passage can flow through a travel path of the lubricant that flows through the lubricant opening and entrains at least part of the lubricant to at least one bearing portion in the scroll compressor for lubrication.

2. The scroll compressor according to aspect 1, wherein the gas diverting passage is a tube and the outlet of the tube is at a lower position than the inlet of the tube.

3. The scroll compressor according to aspect 1 or 2, the scroll compressor further comprising a frame disposed in the shell, wherein the gas diverting passage is an opening formed in the frame and the outlet of the opening is at a lower position than the inlet of the opening.

4. The scroll compressor according to any of aspects 1-3, the scroll compressor further comprising a frame disposed in the shell, wherein the lubricant opening is formed in the frame.

5. The scroll compressor according to any of aspects 1- 4, the scroll compressor further comprising:
   a drive shaft operatively connected with the orbiting scroll; and
   at least one shaft bearing encircling the drive shaft,
   wherein the at least one bearing portion in fluid communication with the lubricant opening includes the at least one shaft bearing.

6. The scroll compressor according to aspect 5, the drive shaft further comprising a drive pin at one end, the at least one shaft bearing comprising a first shaft bearing between the drive pin and the orbiting scroll that couples the drive shaft in driving engagement with the orbiting scroll.

7. The scroll compressor according to any of aspects 1-6, the scroll compressor further comprising a coupling connected with the scroll set for maintaining the orientation of the orbiting scroll with respect to the non-orbiting scroll, the coupling including a sliding surface,
   wherein the at least one bearing portion for lubrication includes the sliding surface of the coupling.

8. The scroll compressor according to any of aspects 1-7 , wherein the scroll set includes a flank surface, and the at least one bearing portion for lubrication includes the flank surface of the scroll set.

9. The scroll compressor according to any of aspects 1-8, wherein the scroll compressor further comprising a seal member between the scroll set and the shell for promoting the gas from the capacity modulator to flow through the gas diverting passage.

10. The scroll compressor according to any of aspects 1-9, the capacity modulator further comprising a slide piston and a port, wherein the slide piston is able to uncover the port for selectively unloading gas from the pockets.

11. A scroll compressor, comprising:
   a shell adapted to contain a lubricant;
   a scroll set in the shell, the scroll set including an orbiting scroll and a non-orbiting scroll, and pockets being formed between the orbiting scroll and the non-orbiting scroll for compressing gas;
   a drive shaft operatively connected with the orbiting scroll in the shell;
   a capacity modulator in fluid communication with the pockets for selectively unloading gas from the pockets;
   a lubricant opening in fluid communication with at least one bearing portion in the scroll compressor; and
   a gas diverting passage in the shell, the gas diverting passage including an inlet and an outlet, the inlet of the gas diverting passage being in fluid communication with the capacity modulator, and the gas diverting passage extending below the lubricant opening such that gas from the outlet of the gas diverting passage can flow through a travel path of the lubricant that exits from the lubricant opening, and entrain the lubricant to a region around the scroll set to lubricate a bearing in the region.

12. The scroll compressor according to aspect 11, the scroll compressor further comprising:
   a coupling connected with the scroll set for maintaining the orientation of the orbiting scroll with respect to the non-orbiting scroll,
   wherein the at least one bearing portion is at least one selected a bearing of the scroll set, a bearing of the coupling, a thrust bearing between the orbiting scroll and the shell, and a tip seal fitted on the scroll set.

13. The scroll compressor according to aspect 11 or 12, wherein the scroll set includes a flank surface, and the at least one bearing portion of the scroll set includes the flank surface of the scroll set.

14. The scroll compressor according to any of aspects 11-13, wherein the gas diverting passage is a tube, wherein the outlet of the tube is at a lower position than the inlet of the tube.

15. The scroll compressor according to any of aspects 11-13, the scroll compressor further comprising a frame disposed in the shell, wherein the gas diverting passage is an opening formed in the frame and the outlet is at a lower position than the inlet.

16. The scroll compressor according to aspect 15, wherein the lubricant opening is formed in the frame.

17. The scroll compressor according to any of aspects 11-16, wherein the drive shaft further comprising a drive pin at one end, the at least one bearing portion includes a shaft bearing comprising a first shaft bearing between the drive pin and the orbiting scroll that couples the drive shaft in driving engagement with the orbiting scroll, and a second shaft bearing for radially supporting the drive shaft.

18. The scroll compressor according to any of aspects 11-17, wherein the scroll compressor further comprising a seal member between the scroll set and the shell for promoting the gas from the capacity modulator to flow through the gas diverting passage.

19. A lubrication system for a scroll compressor, the scroll compressor including: a shell adapted to contain a lubricant; a scroll set in the shell that includes an orbiting scroll and a non-orbiting scroll with pockets being defined between the orbiting scroll and the non-orbiting scroll for compressing gas; a capacity modulator with a port in fluid communication with the pockets for selectively unloading gas from the pockets; and a drive shaft associated with the orbiting scroll in the shell; the lubrication system comprising:

a lubricant opening in fluid communication with at least one bearing portion of the scroll compressor; and a gas diverting passage in the shell, the gas diverting passage including an inlet and an outlet, the inlet of the gas diverting passage adapted to be in fluid communication with the port of the capacity modulator, and the gas diverting passage extending below the lubricant opening such that gas from the outlet of the gas diverting passage can flow through a travel path of the lubricant that exits from the lubricant opening and entrain the lubricant to at least one bearing portion in the scroll compressor for lubrication.

20. The scroll compressor lubrication system according to aspect 19, wherein the gas diverting passage is a tube and the outlet is at a lower position than the inlet; or is an opening formed in a frame disposed in the shell and the outlet is at a lower position than the inlet.

21 A method of lubricating an upper portion of a scroll compressor comprising delivering lubricant through use of the gas diverting passage according to any of aspects 1, 11, and 19.

The invention claimed is:

1. A scroll compressor, comprising:

a shell adapted to contain a lubricant;

a scroll set in the shell, the scroll set including an orbiting scroll and a non-orbiting scroll, wherein pockets being defined between the orbiting scroll and the non-orbiting scroll for compressing gas;

a capacity modulator in fluid communication with the pockets for selectively unloading gas from the pockets;

a lubricant opening in fluid communication with at least one bearing portion of the scroll compressor, lubricant from the at least one bearing portion of the scroll compressor flows through the lubricant opening; and a gas diverting passage in the shell, the gas diverting passage including an inlet and an outlet, the inlet of the gas diverting passage being in fluid communication with the capacity modulator, and the gas diverting passage extending below the lubricant opening such that gas from the outlet of the gas diverting passage can flow through a travel path of the lubricant that flows through the lubricant opening and entrains at least part of the lubricant to at least one bearing portion in the scroll compressor for lubrication.

2. The scroll compressor according to claim 1, wherein the gas diverting passage is a tube and the outlet of the tube is at a lower position than the inlet of the tube.

3. The scroll compressor according to claim 1, the scroll compressor further comprising a frame disposed in the shell, wherein the gas diverting passage is an opening formed in the frame and the outlet of the opening is at a lower position than the inlet of the opening.

4. The scroll compressor according to claim 1, the scroll compressor further comprising a frame disposed in the shell, wherein the lubricant opening is formed in the frame.

5. The scroll compressor according to claim 1, the scroll compressor further comprising:

a drive shaft operatively connected with the orbiting scroll; and at least one shaft bearing encircling the drive shaft, wherein the at least one bearing portion in fluid communication with the lubricant opening includes the at least one shaft bearing.

6. The scroll compressor according to claim 5, the drive shaft further comprising a drive pin at one end, the at least one shaft bearing comprising a first shaft bearing between the drive pin and the orbiting scroll, and that couples the drive shaft in driving engagement with the orbiting scroll.

7. The scroll compressor according to claim 1, the scroll compressor further comprising a coupling connected with the scroll set for maintaining the orientation of the orbiting scroll with respect to the non-orbiting scroll, the coupling including a sliding surface, wherein the at least one bearing portion for lubrication includes the sliding surface of the coupling.

8. The scroll compressor according to claim 1, wherein the scroll set includes a flank surface, and the at least one bearing portion for lubrication includes the flank surface of the scroll set.

9. The scroll compressor according to claim 1, wherein the scroll compressor further comprising a seal member between the scroll set and the shell for promoting the gas from the capacity modulator to flow through the gas diverting passage.

10. The scroll compressor according to claim 1, the capacity modulator further comprising a slide piston and a port, wherein the slide piston is able to uncover the port for selectively unloading gas from the pockets.

11. A scroll compressor, comprising:

a shell adapted to contain a lubricant;

a scroll set in the shell, the scroll set including an orbiting scroll and a non-orbiting scroll, and pockets being formed between the orbiting scroll and the non-orbiting scroll for compressing gas;

a drive shaft operatively connected with the orbiting scroll in the shell;

a capacity modulator in fluid communication with the pockets for selectively unloading gas from the pockets;

a lubricant opening in fluid communication with at least one bearing portion in the scroll compressor; and a gas diverting passage in the shell, the gas diverting passage including an inlet and an outlet, the inlet of the gas diverting passage being in fluid communication with the capacity modulator, and the gas diverting passage extending below the lubricant opening such that gas from the outlet of the gas diverting passage can flow through a travel path of the lubricant that exits from the lubricant opening, and entrain the lubricant to a region around the scroll set to lubricate a bearing in the region.

12. The scroll compressor according to claim 11, the scroll compressor further comprising:

a coupling connected with the scroll set for maintaining the orientation of the orbiting scroll with respect to the non-orbiting scroll, wherein the at least one bearing portion is at least one selected from a bearing of the scroll set, a bearing of the coupling, a thrust bearing between the orbiting scroll and the shell and a tip seal fitted on the scroll set.

13. The scroll compressor according to claim 11, wherein the scroll set includes a flank surface, and the at least one bearing portion of the scroll set includes the flank surface of the scroll set.

14. The scroll compressor according to claim 11, wherein the gas diverting passage is a tube, wherein the outlet of the tube is at a lower position than the inlet of the tube.

15. The scroll compressor according to claim 11, wherein the scroll compressor further comprising a frame disposed in the shell, wherein the gas diverting passage is an opening formed in the frame and the outlet is at a lower position than the inlet.

16. The scroll compressor according to claim 15, wherein the lubricant opening is formed in the frame.

17. The scroll compressor according to claim 11, wherein the drive shaft further comprising a drive pin at one end, the at least one bearing portion includes a shaft bearing comprising a first shaft bearing between the drive pin and the orbiting scroll that couples the drive shaft in driving engagement with the orbiting scroll, and a second shaft bearing for radially supporting the drive shaft.

18. The scroll compressor according to claim 11, wherein the scroll compressor further comprising a seal member between the scroll set and the shell for promoting the gas from the capacity modulator to flow through the gas diverting passage.

19. A lubrication system for a scroll compressor, the scroll compressor including:

a shell adapted to contain a lubricant; a scroll set in the shell that includes an orbiting scroll and a non-orbiting scroll with pockets being defined between the orbiting scroll and the non-orbiting scroll for compressing gas;

a capacity modulator with a port in fluid communication with the pockets for selectively unloading gas from the pockets;

and a drive shaft associated with the orbiting scroll in the shell;

the lubrication system comprising:

a lubricant opening in fluid communication with at least one bearing portion of the scroll compressor; and a gas diverting passage in the shell, the gas diverting passage including an inlet and an outlet, the inlet of the gas diverting passage adapted to be in fluid communication with the port of the capacity modulator, and the gas diverting passage extending below the lubricant opening such that gas from the outlet of the gas diverting passage can flow through a travel path of the lubricant that exits from the lubricant opening and entrain the lubricant to at least one bearing portion in the scroll compressor for lubrication.

20. The scroll compressor lubrication system according to claim 19, wherein the gas diverting passage is a tube and the outlet is at a lower position than the inlet; or is an opening formed in a frame disposed in the shell and the outlet is at a lower position than the inlet.

21. A method of lubricating an upper portion of a scroll compressor comprising:

directing compressed gas from a capacity modulator through a gas diverting passage, the directing being during a partial capacity operation of the scroll compressor;

entraining lubricant flowing from a lubricant opening using the gas directed through the gas diverting passage; and delivering the lubricant to at least one bearing portion of the scroll compressor to lubricate the at least one bearing portion during the partial capacity operation of the scroll compressor.

* * * * *